US005885013A

United States Patent [19]

Burns et al.

[11] Patent Number: 5,885,013

[45] Date of Patent: Mar. 23, 1999

[54] RE-APPLICATION OF DYE TO A DYE DONOR ELEMENT OF THERMAL PRINTERS

[75] Inventors: Elizabeth G. Burns, Rochester; Susan L. Dawson, Pittsford; Elizabeth A. Gallo, Penfield; Daniel J. Harrison, Pittsford; Louis J. Sorriero; Ludmila S. Weiss, both of Rochester, all of N.Y.

[73] Assignee: Eastman Kodak Company, Rochester, N.Y.

[21] Appl. No.: 2,763

[22] Filed: Jan. 5, 1998

[51] Int. Cl.[6] ..... B41J 31/16

[52] U.S. Cl. ..... 400/202.4; 400/198

[58] Field of Search ..... 400/194, 197, 400/198, 200, 202.1, 202.2, 202.3, 202.4, 201, 202

[56] References Cited

U.S. PATENT DOCUMENTS

| | | |
|---|---|---|
| 4,414,555 | 11/1983 | Becker . |
| 4,504,840 | 3/1985 | Evans et al. . |
| 4,661,393 | 4/1987 | Uchiyama et al. . |
| 4,695,288 | 9/1987 | Ducharme . |
| 4,700,207 | 10/1987 | Vanier et al. . |
| 4,713,281 | 12/1987 | Shini . |
| 4,737,486 | 4/1988 | Henzel . |
| 4,865,913 | 9/1989 | Takeuchi et al. . |
| 4,894,283 | 1/1990 | Wehr . |
| 4,916,112 | 4/1990 | Henzel et al. . |
| 4,927,803 | 5/1990 | Bailey et al. . |
| 4,988,667 | 1/1991 | Long . |
| 5,023,228 | 6/1991 | Henzel . |
| 5,043,318 | 8/1991 | Kawakami et al. . |
| 5,090,828 | 2/1992 | Shimura et al. . |
| 5,118,657 | 6/1992 | Kawakami et al. . |
| 5,137,382 | 8/1992 | Miyajima . |
| 5,286,521 | 2/1994 | Matsuda et al. . |
| 5,334,574 | 8/1994 | Matsuda et al. . |
| 5,347,344 | 9/1994 | Itoh . |
| 5,376,619 | 12/1994 | Mochizuki et al. . |
| 5,692,844 | 12/1997 | Harrison et al. . |

*Primary Examiner*—Ren Yan
*Attorney, Agent, or Firm*—Walter S. Stevens

[57] ABSTRACT

Apparatus is disclosed for re-applying dye to a dye donor element of a dye transfer thermal printer. A reservoir contains a supply of dye that is thermally transferred from the reservoir to the dye donor element by diffusion of dye into the dye donor element. The reservoir has a diffusion controlled permeation membrane through which dye is delivered to the dye donor element, while inhibiting diffusion of a binder, whereby the dye diffuses between the reservoir and the dye donor element but the binder does not.

1 Claim, 1 Drawing Sheet

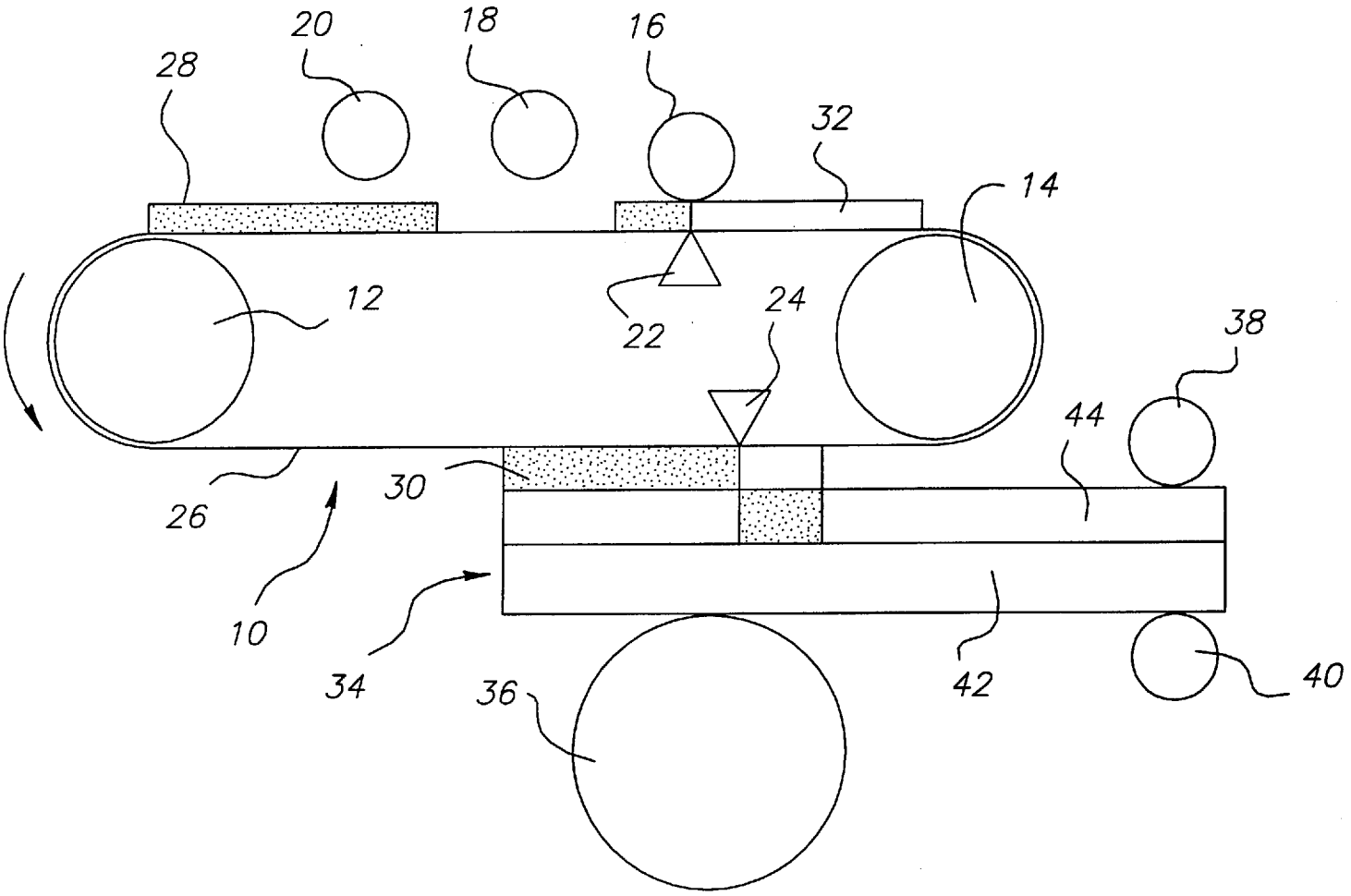
10
12
14
16
18
20
22
24
26
28
30
32
34
36
38
40
42
44

RE-APPLICATION OF DYE TO A DYE DONOR ELEMENT OF THERMAL PRINTERS

CROSS REFERENCE TO RELATED APPLICATIONS

This invention is related to US patent application Ser. No. 08/704,297 filed Aug. 29, 1996 now U.S. Pat. No. 5,692,844 titled "Reapplication of Dye to a Dye Donor Element of Thermal Printers" in the name of Daniel J. Harrison et al.

BACKGROUND OF THE INVENTION

1. Field of the Invention

This invention relates to the re-application of dye to a dye donor element of a thermal dye transfer system, and, more particularly, to the delivery of the dye from a reservoir through a membrane into a dye donor element. A variety of polyolefin or polyolefin containing materials were tested as membranes, and, in general, dye is permeable through the membrane. In addition, a variety of polymeric materials were tested as membranes, and, in general, the ability of dye to diffuse through a membrane increases as its Tg decreases.

2. Background Art

Color dye transfer thermal printers use a dye donor member which may be a sheet, but usually is in the form of a web advanced from a supply roll to a take-up roll. The dye donor member passes between a printhead and a dye receiver member. The thermal printhead comprises a linear array of resistive heat elements. In operation, the resistive heat elements of the printhead are selectively energized in accordance with data from a printhead control circuit. As a result, the image defined by the data from the printhead control circuit is placed on the receiver member.

A significant problem in this technology is that the dye donor members used to make the thermal prints are generally intended for single (one time) use. Thus, although the member has at least three times the area of the final print and contains enough dye to make a solid black image, only a small fraction of this dye is ever used.

After printing an image, the dye donor member cannot be easily reused, although this has been the subject of several patents. The primary reason that inhibits reuse of the dye donor members is that the dye transfer process is very sensitive to the concentration of dye in the donor layer. During the first printing operation, dye is selectively removed from the layer thus altering its concentration. In subsequent printings, regions of the donor member which had been previously imaged have a lower transfer efficiency than regions which were not imaged. This results in a ghost image appearing in subsequent prints.

The cost associated with having a single use donor ribbon is large because of the large area of ribbon required, as well as the large excess of dye coated on the donor member. While this technology is able to produce high quality continuous tone color prints, it is desired to provide an approach which has all of the good attributes of thermal dye transfer imaging but without the limitations associated with single use donor members.

Some work has been done by others to accomplish similar goals. For example, U.S. Pat. No. 5,286,521 discusses a reusable wax transfer ink donor ribbon. This process is intended to provide a dye donor ribbon that may be used to print more than one page before the ribbon is completely consumed. U.S. Pat. No. 4,661,393 describes a reusable ink ribbon, again for wax transfer printing. The ink ribbon contains fine inorganic particles and low melting waxy materials to assist in the repeated use of this ribbon. U.S. Pat. No. 5,137,382 discloses a printer device capable of re-inking a thermal transfer ribbon. However, again the technology is wax transfer rather than dye transfer. In the device, solid wax is melted and transferred using a roller onto the reusable transfer ribbon.

U.S. Pat. No. 5,334,574 describes a reusable dye donor ribbon for thermal dye transfer printing. This reusable ribbon has multiple layers containing dye which limit the diffusion of dye out of the donor sheet. This enables the ribbon to be used to make multiple prints. In addition, the ribbon may be run at a slower speed than the dye receiver sheet, enabling additional utilization. U.S. Pat. No. 5,118,657 describes a multiple use thermal dye transfer ink ribbon. This ribbon has a high concentration dye layer on the bottom and a low concentration dye layer on the top. The low concentration dye layer meters or controls dye transfer out of the ribbon. This enables the ribbon to be used multiple times. U.S. Pat. No. 5,043,318 is another example of a thermal dye transfer ribbon which can be used multiple times.

Accordingly, there is no prior art known to us which directly relates to the concept of the re-application of dye to a dye donor ribbon.

DISCLOSURE OF THE INVENTION

It is a feature of the present invention to provide a reservoir containing a supply of dye which is transferred from the reservoir to the dye donor element by diffusion of dye into the dye donor element.

It is another feature of the present invention to provide a reservoir containing a supply of dye, the reservoir having a diffusion controlled permeation membrane through which dye is delivered to the dye donor element.

It is still another feature of the present invention to provide a diffusion controlled permeation membrane which inhibits diffusion of an optional binder, whereby the dye partitions or diffuses between the reservoir and the dye donor element but the binder does not. The reservoir may also include a porous sub-layer covered by the diffusion controlled permeation membrane through which dye is delivered from the sub-layer to the dye donor element. Further, the reservoir may be a roller with the membrane forming a cylindrical cover for the sub-layer.

According to the invention, dye is thermally transferred from a reservoir to the depleted donor patch. The dye and a binder are contained in the reservoir. The reservoir is covered with a diffusion controlled permeation membrane. With the addition of heat, dye diffuses through the membrane and is delivered to the donor patch. The dye partitions between the reservoir and the donor patch reestablishing the original dye concentration.

Accordingly, the invention resides in an apparatus for re-applying dye to a dye donor element of a dye transfer thermal printer, the apparatus comprising a thermal dye donor element; a printing station at which dye is imagewise transferred from the dye donor element to a receiver medium, at least partially depleting the dye donor element of dye; a reservoir containing dye and an optional binder; and means for transferring dye from the reservoir to the dye donor element by separating the dye from the binder by diffusion of dye into the dye donor element wherein the reservoir includes a diffusion controlled permeation membrane through which dye is delivered to the dye donor element and wherein said membrane comprises a linear, branched and/or crosslinked polymer or copolymer.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawing, which is a schematic side view of a dye donor ribbon thermal printer according to the present invention.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art.

Referring to the drawing, a reusable dye donor member is provided, such as in the form of a belt 10 that is trained about a pair of rollers 12 and 14. At least one of the two rollers is driven to advance belt 10 past a plurality of dye reservoir rollers 16, 18, and 20; one or more re-ink heads 22; and a printhead 24 at a printing station.

Donor member belt 10 comprises a support 26 and a dye donor element such as a plurality of dye donor patches 28, 30 and 32. Any material can be used as the support for the dye donor element of the invention provided it is dimensionally stable and can withstand the heat of the laser or thermal head. Such materials include aluminum or other metals; polymers loaded with carbon black; metal/polymer composites such as polymers metalized with 500–1000 Å of metal; polyesters such as polyethylene terephthalate, polyethylene naphthalate, etc.; polyamides; polycarbonates; cellulose esters such as cellulose acetate; fluorine polymers such as poly(vinylidene fluoride) or poly (tetrafluoroethylene-co-hexafluoropropylene); polyethers such as polyphenyleneoxide; polyacetals; and polyimides such as polyimide-amides and polyether-imides. The support generally has a thickness of from about 5 $\mu$m to about 200 $\mu$m and may also be coated with a subbing layer, if desired, such as those materials described in U.S. Pat. Nos. 4,695,288 or 4,737,486.

In the illustrated embodiment, the dye donor element is in the form of a distinct dye donor patch on the support for each color, or separate belts, dye reservoirs and printheads may be used for each color. However, a continuous dye donor element over the entire support surface may be used, with machine logic subdividing the single element into dedicated color regions. Likewise, more than three patches may be used. The dye is dispersed in a polymeric binder such as cellulose and derivatives of cellulose to include cellulose acetate hydrogen phthalate, cellulose acetate, cellulose acetate propionate, cellulose acetate butyrate, and cellulose triacetate, poly(vinyl acetal), poly(vinyl alcohol-co-butyral) and any of the polymers described in U.S. Pat. No. 4,700,207; polyurethanes, polyesters, polyamides, polyacrylamides, acrylates, poly(vinyl alcohol), polyimides, polyethers, polystyrene, poly(siloxanes), polysulfone, polycarbonate, acrylics, gelatin, polyolefin, poly(nitrile), poly(dienes), polyacetal, polybutyral and their copolymers.

In the illustrated embodiment, conventional yellow, magenta and cyan dyes used in thermal dye transfer systems can be used and are well known to those skilled in the art.

Any dye can be used in the dye-donor element provided it is transferable to the dye-receiver by the action of heat. Especially good results have been obtained with sublimable dyes. Dyes useful in the present invention are described in U.S. Pat. Nos. 4,916,112; 4,927,803 and 5,023,228, the disclosures of which are hereby incorporated by reference.

A conventional dye receiver medium 34 is drawn through a nip formed between printhead 24 and a platen roller 36 by a capstan drive roller pair 38 and 40. Dye receiver medium 34 is conventional, and includes a support 42 and a receiving layer 44. Image-wise activation of linear printhead 24 causes dye to be transferred from the dye donor element of belt 10 into the dye receiving layer of medium 34; at least partially image-wise depleting portions of the patches of dye.

Dye reservoir rollers 16, 18, and 20 include a permeation membrane. Examples of membrane material include Polyethylene CM751-X™, CM752-X™, CM755-X™ and CM756-X™ (Eastman Chemical); Polyethylene Attane 4201™ and 4203™ (Dow Chemical); Polyethylene ETS-9066™, (Union Carbide); Polyethylene 4002P™ (Eastman Chemical); Kraton D1102™, D1111™, D1116™, G1652™, G1657™ and G1702™ (Shell Chemical Co.); polyurethane of isophorone diisocyanate, 2-ethyl-1,3-hexane diol and hydroxy terminated poly(ethylene-co-butylene); poly[(2,2'-oxydiethylene-co-2,2-dimethyl-1,3-propylene (20/80) terephthalate-block-poly(ethylene-co-butylene)]; poly [ethylene terephthalate-block-poly(ethylene-co-butylene)]; poly[1,6-hexylene terephthalate-block-poly(ethylene-co-butylene)]; poly(ethylene-co-propylene), ethylene content 60 wt. %; poly(ethylene-co-ethyl acrylate), ethyl acrylate content 18 wt. %; poly(ethylene-co-vinyl acetate), vinyl acetate content 14 wt. %; polybutadiene; polystyrene-block-polybutadiene-block-polystyrene, styrene content 30 wt. %; acrylonitrile/butadiene/styrene resin; polystyrene-block-polyisoprene-block-polystyrene; styrene content 14 wt. %; poly(acrylonitrile-co-butadiene), acrylonitrile content 30–32 wt. %; poly(ethylene oxide); poly(vinyl acetate); poly(vinyl chloride-co-vinyl acetate), vinyl chloride content 87 wt. %, vinyl acetate content 13 wt. %; poly(vinyl butyral); polyvinyl acetal resin #S-LEC KS-1™ (Sekisui Chemical); poly(n-butyl methacrylate); poly(isopropyl acrylate); poly(isobutyl methacrylate); poly(2-hydroxyethyl methacrylate); poly(sec-butyl methacrylate); poly(ethyl methacrylate); poly(hydroxypropyl methacrylate); poly (isopropyl methacrylate); polystyrene; poly(1-butene), isotactic; copolymer of carbonic acid with 4,4'-(hexahydro-4,7-methanoindan-5-ylidene) diphenol; copolymer of carbonic acid with 50 wt. % Bisphenol A, diethylene glycol and 15 wt. % block-poly(dimethylsiloxane); copolymer of carbonic acid with 4,4'-(hexahydro-4,7-methanoindan-5-ylidene) diphenol and 40 wt. % block-poly (dimethylsiloxane); and copolymer of isophthalic acid with 4,4'-(hexahydro4,7-methanoindan-5-ylidene) diphenol and 40 wt. % block-poly(dimethylsiloxane).

Dye reservoir rollers 16, 18, and 20 may be replaced by wicks formed of similar materials, but not mounted for rotation.

Each dye reservoir roller is opposed by a re-ink head 22 (only one head is illustrated in the drawing), and the rollers are selectively raised and lowered into contact with belt 10 as necessary. When a dye reservoir roller is lowered to the belt, and the associated re-ink head activated, heat and/or pressure between the dye reservoir roller and belt 10 effects re-inking of the dye donor element, and the depleted dye donor layer of the patch is re-saturated with dye from the dye reservoir roller.

In this method, dye is thermally transferred from a reservoir to the depleted donor patch. The dye and an optional binder are contained in the reservoir. The reservoir is covered with a diffusion controlled permeation membrane. With the addition of heat, dye diffuses through the membrane and is delivered to the donor patch. The dye partitions between the reservoir and the donor patch reestablishing the original dye concentration.

Dye transfer from the reservoir through the semi-permeable membrane may not require a binder. In a solid dye transfer mechanism, dye would melt or liquefy and diffuse through the membrane to re-ink the donor patch.

Preparation of the Dye Reservoir Elements

Dye Reservoir Element 1

Dye Reservoir Element 1 was prepared by coating on 13 μm Mylar TTM™ support:

1) a subbing layer of Tyzor TBT™ titanium tetrabutoxide (DuPont Company) (0.16 g/m$^2$) from a solvent mixture of 15 wt % 1-butanol and 85 wt % n-propyl acetate; and
2) a dye layer containing Dye 1 (1.62 g/m$^2$), Dye 2 (3.32 g/m$^2$), Dye 3 (1.48 g/m$^2$ ), FC-430™ fluorocarbon surfactant (3M Company) (0.01 g/m$^2$) and CAP-482-0.5™ cellulose acetate propionate binder (Eastman Chemical) (1.78 g/m$^2$) from a solvent mixture of 75 wt % toluene, 20 wt % methanol and 5 wt % cyclopentanone.

On the back side of Dye Reservoir Element 1 was coated a subbing layer as described above.

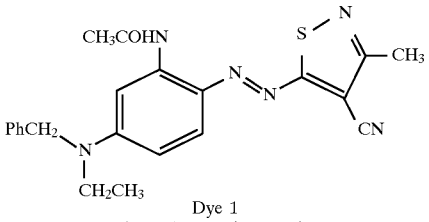

Dye 1
$\lambda_{max}$ 544 nm (magenta)

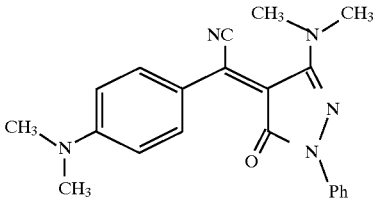

Dye 2
$\lambda_{max}$ 522 nm (magenta)

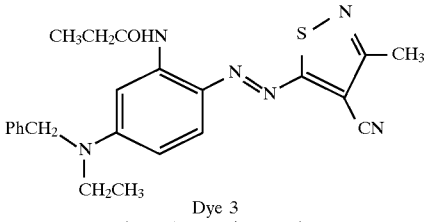

Dye 3
$\lambda_{max}$ 544 nm (magenta)

Dye Reservoir Element 2

Dye Reservoir Element 2 was prepared by coating on 13 μm Mylar TTM™ support (DuPont Company):

1) a subbing layer as described in Dye Reservoir Element 1; and
2) a dye layer containing Dye 1 (0.81 g/m$^2$), Dye 2 (1.66 g/m$^2$), Dye 3 (0.74 g/m$^2$), FC-430™ fluorocarbon surfactant (3M Company) (0.01 g/m$^2$) and Butvar B-76™ poly(vinylbutyral) binder (Monsanto Corp.) (1.78 g/m$^2$) from a solvent mixture of 75 wt % toluene, 20 wt % methanol and 5 wt % cyclopentanone.

On the back side of the dye donor element was coated a subbing layer as described in Dye Reservoir Element 1.

Dye Reservoir Element 3

Dye Reservoir Element 3 was prepared by coating on 13 μm Mylar

TTM™ support (DuPont Company)

1) a subbing layer as described in Dye Reservoir Element 1; and
2) a dye layer containing Dye 1 (4.02 g/m$^2$), Dye 2 (8.54 g/m$^2$), Dye 3 (3.68 g/m$^2$) from a solvent mixture of 75 wt % toluene, 20 wt % methanol and 5 wt % cyclopentanone.

On the back side of the dye donor element was coated a subbing layer as described in Dye Reservoir Element 1.

Dye Reservoir Element 4

Dye Reservoir Element 4 was prepared by coating on 13 μm Mylar TTM™ support (DuPont Company)

1) a subbing layer as described in Dye Reservoir Element 1; and
2) a dye layer containing Dye 1 (0.81 g/m$^2$), Dye 2 (1.66 g/m$^2$), Dye 3 (0.74 g/m$^2$), FC-430™ fluorocarbon surfactant (3M Company) (0.01 g/m$^2$) and CAP-482-0.5™ cellulose acetate propionate binder(Eastman Chemical) (1.78 g/m$^2$) from a solvent mixture of 75 wt % toluene, 20 wt % methanol and 5 wt % cyclopentanone.

On the back side of the dye donor element was coated a subbing layer as described in Dye Reservoir Element 1.

Preparation of the Dye Donor Element

The Dye Donor Element was prepared by coating on 13 μm Mylar TTM™ support (DuPont Company):

1) a subbing layer as described in Dye Reservoir Element 1; and
2) a binder layer of a crosslinked polycarbonate-polyurethane network derived from polycarbonate polyol (0.238 g/m$^2$) with main chain shown below and prepared as disclosed in U.S. Pat. No. 5,266,551, CL2000™ polycaprolactone polyether glycol (DuPont Company) (0.238 g/m$^2$), Desmodur N3300™ polyisocyanate (Bayer Corp.) (0.063 g/m$^2$), dibutyltin diacetate catalyst (Air Products) (0.001 g/m$^2$) and FC-430™ fluorocarbon surfactant (3M Company) (0.003 g/m$^2$) from a solution in ethyl acetate.

On the back side of the dye donor element was coated a subbing layer as described in Dye Reservoir Element 1.

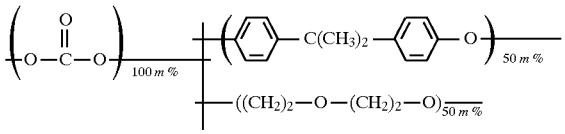

Polycarbonate Polyol

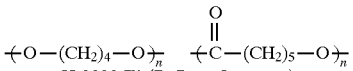

CL2000 ™ (DuPont Company)

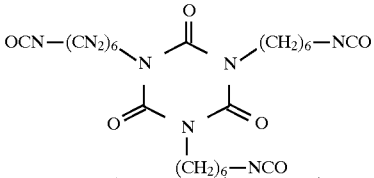

Desmodur N3300 ™ (Bayer Corp.)

Preparation of Membrane Elements

Polymers evaluated as membranes are:

Polymer 1: Polyethylene CM751-X™ (Eastman Chemical)

Polymer 2: Polyethylene CM752-X™ (Eastman Chemical)

Polymer 3: Polyethylene CM755-X™ (Eastman Chemical)

Polymer 4: Polyethylene CM756-X™ (Eastman Chemical)

Polymer 5: Polyethylene Attane 4201™ (Dow Chemical)

Polymer 6: Polyethylene Attane 4203™ (Dow Chemical)

Polymer 7: Polyethylene ETS-9066™ (Union Carbide)

Polymer 8: Polyethylene 4002P™ (Eastman Chemical)

Polymer 9: Kraton D1102™ (Shell Chemical Co.)

Polymer 10: Kraton D1111™ (Shell Chemical Co.)

Polymer 11: Kraton D1116™ (Shell Chemical Co.)

Polymer 12: Kraton G1652™ (Shell Chemical Co.)

Polymer 13: Kraton G1657™ (Shell Chemical Co.)

Polymer 14: Kraton G1702™ (Shell Chemical Co.)

Polymer 15: Polyurethane of isophorone diisocyanate, 2-ethyl-1,3-hexane diol and hydroxy terminated poly (ethylene-co-butylene)

Polymer 16: Poly[(2,2'-oxydiethylene-co-2,2-dimethyl- 1,3-propylene (20/80) terephthalate-block-poly(ethylene-co-butylene)]

Polymer 17: Poly[ethylene terephthalate-block-poly (ethylene-co-butylene)]

Polymer 18: Poly[1,6-hexylene terephthalate-block-poly (ethylene-co-butylene)]

Polymer 19: Poly(ethylene-co-propylene), ethylene content 60 wt. %; Scientific Polymer Products, Inc. #358

Polymer 20: Poly(ethylene-co-ethyl acrylate), ethyl acrylate content 18 wt. %; Scientific Polymer Products, Inc. #454

Polymer 21: Poly(ethylene-co-vinyl acetate), vinyl acetate content 14 wt. %; Scientific Polymer Products, Inc. #012

Polymer 22: Polybutadiene; Aldrich Chemical Co. #18, 138-2

Polymer 29: Poly(vinyl chloride-co-vinyl acetate), vinyl chloride content 87 wt. %, vinyl acetate content 13 wt. %; Scientific Polymer Products, Inc. #063

Polymer 30: Poly(vinyl butyral); Scientific Polymer Products, Inc. #073

Polymer 31: Polyvinyl acetal resin; Sekisui Chemical #S-LEC KS-1

Polymer 32: Poly(n-butyl methacrylate); Scientific Polymer Products, Inc. #111

Polymer 33: Poly(isopropyl acrylate); Scientific Polymer Products, Inc. #475

Polymer 34: Poly(isobutyl methacrylate); Scientific Polymer Products, Inc. #112

Polymer 35: Poly(2-hydroxyethyl methacrylate); Scientific Polymer Products, Inc. #414

Polymer 36: Poly(sec-butyl methacrylate); Scientific Polymer Products, Inc. #213

Polymer 37: Poly(ethyl methacrylate); Scientific Polymer Products, Inc. #113

Polymer 38: Poly(hydroxypropyl methacrylate); Scientific Polymer Products, Inc. #232

Polymer 39: Poly(isopropyl methacrylate); Scientific Polymer Products, Inc. #476

Polymer 40: Polystyrene; Scientific Polymer Products, Inc. #067

Polymer 41: Poly(1-butene), isotactic; Scientific Polymer Products, Inc. #039

Polymer 42: Copolymer of carbonic acid with 4,4'-(hexahydro-4,7-methanoindan-5-ylidene) diphenol

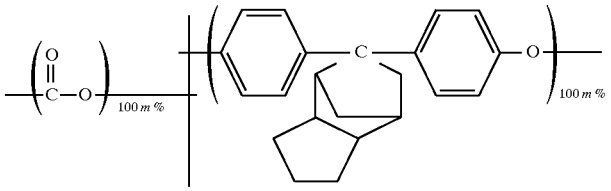

Polymer 42

Polymer 23: Polystyrene-block-polybutadiene-block-polystyrene, styrene content 30 wt. %; Scientific Polymer Products, Inc. #086

Polymer 24: Acrylonitrile/butadiene/styrene resin; Scientific Polymer Products, Inc. #051

Polymer 25: Polystyrene-block-polyisoprene-block-polystyrene, styrene content 14 wt. %; Scientific Polymer Products, Inc. #088

Polymer 26: Poly(acrylonitrile-co-butadiene), acrylonitrile content 30–32 wt. %; Aldrich Chemical Co. #18,090-4

Polymer 27: Poly(ethylene oxide); Scientific Polymer Products, Inc. #136A

Polymer 28: Poly(vinyl acetate); Scientific Polymer Products, Inc. #070

Polymer 43: Copolymer of carbonic acid with 50 wt. % Bisphenol A, diethylene glycol and 15 wt. % block-poly (dimethylsiloxane)

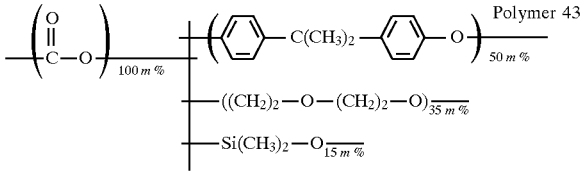

Polymer 43

Polymer 44: Copolymer of carbonic acid with 4,4'-(hexahydro-4,7-methanoindan-5-ylidene) diphenol and 40 wt. % block-poly(dimethylsiloxane)

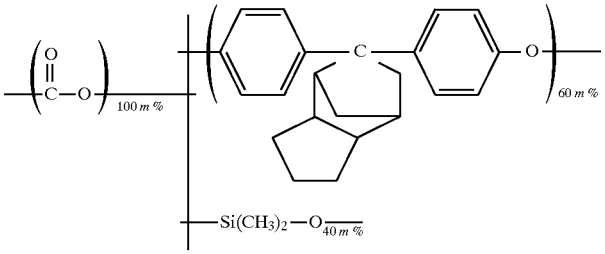

Polymer 44

Polymer 45: Copolymer of isophthalic acid with 4,4'-(hexahydro-4,7-methanoindan-5-ylidene) diphenol and 40 wt. % block-poly(dimethylsiloxane)

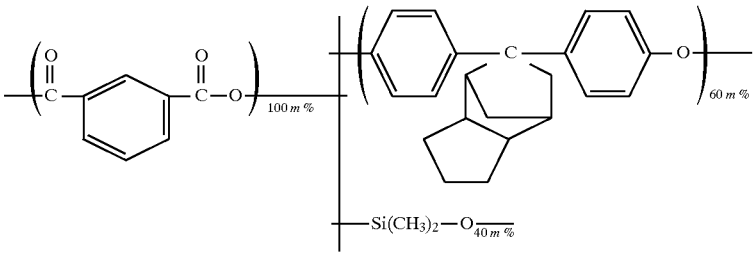

Polymer 45

Polymer 16 was prepared by combining dimethylterephthalate (19.4 g, 0.100 moles) and Kraton L-2203™ (Shell Chemical Co., 34.0 g, 0.005 moles) in a 500 mL round-bottomed flask equipped with a stirrer and an argon inlet. Under an argon stream the monomers were first melted at 220° C. Three drops of neat titanium isopropoxide were added and the resulting methanol distillate was collected. After 40 minutes 2,2-dimethyl-1,3-propanediol (12.5 g, 0.120 moles) and 2,2'-oxydiethanol (3.2 g, 0.030 moles) were added. The reaction continued for two hours at 220° C. and 1 hr at 240° C. again collecting the resulting methanol distillate. A vacuum manifold and a stir paddle were attached to the flask, and a vacuum applied with stirring. The flask was then allowed to cool to room temperature for 30 minutes, before the vacuum was released. The solid polymer was isolated by freezing the flask in liquid nitrogen and breaking the flask.

Polymer 17 was prepared by combining dimethylterephthalate (2.86 g, 0.0147 moles), Kraton L-2203™ (Shell Chemical Co., 12.5 g, 0.00735 moles) and ethylene glycol (2 g, 0.032 moles) into a 250 mL round-bottomed, long-necked flask. A take-off arm was attached to the top of the flask. Under a nitrogen stream the monomers were first melted at 200° C., then the molten monomers were purged with nitrogen. Antimony pentoxide, 0.5 mL of a 6% dispersion in ethylene glycol was added. Five drops of neat titanium isopropoxide were added, and the resulting methanol distillate was collected. After two hours, a vacuum manifold and a stir paddle were attached to the flask, and a vacuum applied with stirring. The reaction continued for two hours under vacuum. The flask was then allowed to cool to room temperature for 30 minutes before the vacuum was released. The solid polymer was isolated by freezing the flask in liquid nitrogen and breaking the flask.

Polymer 18 was prepared in the same way as Polymer 17, using dimethylterephthalate (15.5 g, 0.08 moles), Kraton L-2203™ (20.4 g, 0.012 moles) and 1,6-hexanediol (8.02 g, 0.068 moles).

Polymers 42 through 45 were synthesized using a method similar to that for Polymer 43: A 500 mL three-necked, round-bottomed flask fitted with a condenser, dropping funnel and stirrer was charged with bisphenol A bischloroformate (35.3 g, 0.10 mole), 2,2'-oxydiethanol (10.6 g, 0.10 mole), poly(dimethyl siloxane) (8.1 g, 0.0021 mole) and dichloromethane (200 mL) and cooled to 5°–10° C. with an ice bath. Pyridine (25 mL) was slowly added followed by a solution of bisphenol A bischloroformate in dichloromethane (0.01 mole %) until the solution viscosity began to increase. The resulting mixture was stirred or three hours and was then washed three times with 2% HCl (200 mL) followed by three times with water (200 mL). The polymer was precipitated into methanol, redissolved into dichloromethane, washed with HCl and water as described above, and re-precipitated into methanol. The resulting polymer was then dried in a vacuum oven overnight at 50° C.

Membrane Elements 1, 2*a*, 3*a* and 4 through 8

Prepared by casting the corresponding Polymers 1 through 8 as thin films using a Tetrahedron Press at 177–204° C. and 222,000–267,000 N. Membrane thicknesses were measured using a Newport micrometer (Table 1).

Membrane Elements 2*b* and 3*b*

Polymers 2 and 3 were received as films from Eastman Chemical. Thicknesses were measured using a Newport micrometer (Table 2).

Membrane Elements 9 through 14

Prepared by coating the corresponding Polymers 9 through 14 on 25 μm FEP Teflon™ support (DuPont Company) from toluene (8% solids). The coatings were dried overnight at room temperature before the membranes were removed. Membrane thicknesses were measured using a Newport micrometer (Table 2).

Membrane Element 15

Polymer 15 was prepared by coating a solution of Kraton L-2203™ (Shell Chemical Co.) (3.62 g/m$^2$), Desmodur Z™ polyisocyanate (Bayer Corp.) (2.52 g/m$^2$), dibutyltin diacetate catalyst (Air Products) (0.0152 g/m$^2$) from a toluene solution onto a glass plate. The coating was cured in the oven at 32° C. for two days. The resulting Membrane Element 15 was peeled from the plate, and the thickness was measured using a Newport micrometer (Table 3).

Membrane Elements 16 and 17

Prepared by coating the corresponding Polymers 16 and 17 on 30 μm Kapton 120FN616™ support (DuPont Company) from toluene (8% solids). The coatings were dried overnight at room temperature before the membranes were removed. Membrane thicknesses were measured using a Newport micrometer (Table 3).

Membrane Element 18

Prepared by coating the corresponding Polymer 18 on 30 μm Kapton 120FN616™ support (DuPont Company) from dichloromethane (8% solids). The coating was dried overnight at room temperature before the membrane was removed from the support. Membrane thickness was measured using a Newport micrometer (Table 3).

Membrane Elements 19–45 were prepared from the corresponding Polymers 19–45. For all examples, the solutions described below were coated onto the supports described below, and the resulting coatings were allowed to dry overnight at room temperature. The resulting films were then peeled from the supports, and the thicknesses measured using a Newton micrometer (Table 4).

Membrane Elements 19 and 22

Coated from 2.5 wt. % in toluene on 25 μm FEP Teflon™ support (DuPont).

Membrane Element 20

Coated from 2.5 wt. % in toluene on a glass plate.

Membrane Elements 21, 27, 28, 32, 34, 37, 40, 41, 42 and 44

Coated from 22 wt. % in toluene on 30 μm Kapton 120FN616™ (DuPont Company).

Membrane Element 23

Coated from 22 wt. % in toluene on 125 μm Kapton 500FN131™(DuPont Company).

Membrane Element 24

Coated from 1.5 wt. % in solvent mixture 50 wt. % toluene and 50 wt. % 2-butanone on a glass plate.

Membrane Element 26

Coated from 3.5 wt. % in THF on 25 μm FEP Teflon™ support (DuPont).

Membrane Element 29

Coated from 7.0 wt. % in THF on a glass plate.

Membrane Element 30

Coated from 22 wt. % in 2-butanone on 30 mm Kapton 120FN616™ (DuPont Company).

Membrane Element 31

Coated from 5.0 wt. % in solvent mixture 50 wt. % toluene and 50 wt. % methanol on 25 μm FEP Teflon™ support (DuPont Company).

Membrane Elements 33 and 39

Coated from 10.0 wt. % in toluene on 30 μm Kapton 120FN616™ (DuPont Company).

Membrane Elements 35 and 38

Coated from 10.0 wt. % in MeOH on 30 μm Kapton 120FN616™ (DuPont Company).

Membrane Element 36

Coated from 5.0 wt. % in toluene on 25 μm FEP Teflon™ support (DuPont).

Membrane Elements 43 and 45

Coated from 3.5 wt. % in THF on 25 μm FEP Teflon™ support (DuPont).

EXAMPLE 1

Thermal Dye Diffusion Through Membrane Elements 1, 2*a*, 3*a* and 4 through 8

Each Membrane Element was placed between Dye Reservoir Element 1 and the Dye Donor Element such that the supports of the latter two materials were visible on the outsides of each assembly. With the Dye Donor Element on top, each assembly was passed at a speed of 0.23 cm/sec through a laminator consisting of two aluminum rubber-coated rollers held at $2.1\times10^4$ N/m$^2$ pressure with a 5 mm nip width. The temperatures of the upper and lower rollers were held at 135° and 91° C., respectively, by heating only the upper roller. The assemblies were allowed to cool for several minutes before removing the inked Dye Donor Elements. Status A green transmission densities were measured using an X-Rite 820 densitometer (Table 1).

EXAMPLE 2

Thermal Dye Diffusion Through Membrane Elements 2*b*, 3*b* and 9 through 14

Dye diffusion was carried out as described in Example 1 except that Dye Reservoir 2 was used instead of Dye Reservoir 1. The results are summarized in Table 2.

TABLE 1

| Membrane Element | Polymer | Thickness, μm | Status A Green Transmission Density |
|---|---|---|---|
| 1 | 1 | 31 | 0.24 |
| 2a | 2 | 46 | 0.22 |
| 3a | 3 | 33 | 0.31 |
| 4 | 4 | 39 | 0.19 |
| 5 | 5 | 52 | 0.15 |
| 6 | 6 | 48 | 0.20 |
| 7 | 7 | 40 | 0.21 |
| 8 | 8 | 29 | 0.24 |

TABLE 2

| Membrane Element | Polymer | Thickness, μm | Status A Green Transmission Density |
|---|---|---|---|
| 2b | 2 | 23 | 0.86 |
| 3b | 3 | 26 | 0.62 |
| 9 | 9 | 13 | 1.0 |
| 10 | 10 | 18 | 0.79 |
| 11 | 11 | 16 | 0.99 |
| 12 | 12 | 18 | 0.40 |
| 13 | 13 | 13 | 1.01 |
| 14 | 14 | 11 | 0.50 |

EXAMPLE 3

Thermal Dye Diffusion Through Membrane Element 15

Dye diffusion was carried out as described in Example 1 except that Dye Reservoir 3 was used instead of Dye Reservoir 1, and the upper roller was heated to 163° C. instead of 135° C. The results are summarized in Table 3.

EXAMPLE 4

Thermal Dye Diffusion Through Membrane Elements 16 and 17

Dye diffusion was carried out as described in Example 1 except that the upper roller was heated to 163° C. instead of 135° C. and each assembly was passed through the laminator two times instead of one time. The results are summarized in Table 3.

EXAMPLE 5

Thermal Dye Diffusion Through Membrane Element 18

Dye diffusion was carried out as described in Example 1 except that Dye Reservoir 2 was used instead of Dye Reservoir 1 and the upper roller was heated to 163° instead of 135° C. The results are summarized in Table 3.

TABLE 3

| Membrane Element | Polymer | Thickness, μm | Status A Green Transmission Density |
|---|---|---|---|
| 17 | 15 | 77 | 0.05 |
| 18 | 16 | 25 | 0.12 |
| 19 | 17 | 23 | 1.3 |
| 20 | 18 | 15 | 0.70 |

EXAMPLE 6

Thermal Dye Diffusion Through Membrane Elements 19 through 24, 26 through 29 and 31 through 45

Dye diffusion was carried out as described in Example 1 except that Dye Reservoir 2 was used instead of Dye Reservoir 1. The results are summarized in Table 4.

EXAMPLE 7

Thermal Dye Diffusion Through Membrane Elements 25 and 30

Dye diffusion was carried out as described in Example 1 except that Dye Reservoir 4 was used instead of Dye Reservoir 1. The results are summarized in Table 4.

The data in Table 4 show that, in general, the ability of dye to pass through a polymeric membrane increases as its $T_g$ decreases.

yet another process may be used for dye diffusion from the reservoir through the semi-permeable membrane which may not require any binder. That is, in a solid dye transfer mechanism, dye would melt and diffuse through the membrane to re-ink the donor patch.

TABLE 4

| Membrane Element | Thickness (μm) | Tg (°C.) | Status A Green Transmission Density |
|---|---|---|---|
| 20 | 13 | none | 2.8 |
| 21 | 11 | none | 1.4 |
| 22 | 11 | −95[2] | >3 |
| 23 | 12 | −92/94[3] | 0.9 |
| 24 | 12 | −85/101[3] | 0.10 |
| 27 | 9 | −67[2] | >3 |
| 25 | 6 | −61[3] | 0.8 |
| 19 | 22 | −50[2] | 1.6 |
| 26 | 16 | −26[3] | 0.40 |
| 41 | 12 | −24[2] | 0.01 |
| 32 | 7 | −20[2] | 0 |
| 33 | 13 | −3[2] | 0.28 |
| 28 | 11 | 30[2] | 1.8 |
| 34 | 6 | 55[2] | 0 |

TABLE 4-continued

| Membrane Element | Thickness (μm) | Tg (°C.) | Status A Green Transmission Density |
|---|---|---|---|
| 35 | 20 | 55[2] | 0.03 |
| 36 | 14 | 60[2] | 0 |
| 30 | 6 | 64[3] | 1.5 |
| 37 | 7 | 66[2] | 0 |
| 43 | 6 | 67[3] | 0.16 |
| 29 | 14 | 70[3] | 2.7 |
| 38 | 24 | 73[2] | 0.09 |
| 39 | 17 | 81[2] | 0 |
| 40 | 14 | 100[2] | 0 |
| 31 | 11 | 110[3] | 0 |
| 42 | 8 | 245[3] | 0 |
| 44 | 6 | 253[3] | 0 |
| 45 | 14 | 264[3] | 0 |

[1]Dye Reservoir Element 2 was used in place of Dye Reservoir Element 1.
[2]Supplier.
[3]Measured for bulk material by heating at 10° C./min; recorded at inflection midpoint of the DSC curve.

It is a feature of one aspect of the present invention that, during the re-diffusion, dye separates from the binder. A semi-permeable membrane allows only the dye to diffuse out of the dye supply and into the donor member. Binder is retained within the supply. Other methods of replenishment require that binder is removed either prior to the replenishment step (intermediate transfer) or after transfer of dye to the donor ribbon. Binders must be volatile in these alternative approaches. In addition, the removal of binders results in more complex hardware as well as the potential health and safety problems associated with this process.

The invention has been described in detail with particular reference to preferred embodiments thereof, but it will be understood that variations and modifications can be effected within the spirit and scope of the invention.

What is claimed is:

1. Apparatus for re-applying dye to a dye donor element of a dye transfer thermal printer, said apparatus comprising:

a thermal dye donor element;

a printing station at which dye is image-wise transferred from the dye donor element to a receiver medium, at least partially depleting the dye donor element of dye;

a reservoir comprised of dye and binder; and means for transferring dye from the reservoir to the dye donor element by separating the dye from the binder by diffusion of dye into the dye donor element wherein the reservoir includes a diffusion controlled permeation membrane through which dye is delivered to the dye donor element and wherein said membrane comprises a linear, branched and/or crosslinked polymer or copolymer.

* * * * *